US005221820A

United States Patent [19]

Shimoji

[11] Patent Number: 5,221,820

[45] Date of Patent: Jun. 22, 1993

[54] LASER CIGARETTE LIGHTER

[75] Inventor: Yutaka Shimoji, Clearwater, Fla.

[73] Assignee: Win International, Inc., Panama City, Fla.

[21] Appl. No.: 806,318

[22] Filed: Dec. 13, 1991

[51] Int. Cl.[5] ..... B23K 26/00

[52] U.S. Cl. ..... 219/121.6; 219/121.75; 431/258

[58] Field of Search ..... 219/121.6, 121.75, 121.73, 219/121.85, 121.74

[56] References Cited

U.S. PATENT DOCUMENTS 3,419,321 2/1966 Barber et al. ..... 350/8
3,915,623 10/1975 Wormser ..... 431/347
3,947,093 3/1976 Goshima et al. ..... 350/189
4,069,080 1/1978 Osborne ..... 219/121.75 X
4,859,174 8/1989 Zellweger ..... 431/255
4,929,174 5/1990 Wang ..... 431/276

*Primary Examiner*—C. L. Albritton
*Attorney, Agent, or Firm*—Hopkins & Thomas

[57] ABSTRACT

An electrically powered portable cigarette lighter includes a laser for generating a beam of energy, a focusing system for forming the beam of energy into a substantially hollow doughnut shaped beam which is focused to a point in the region of the end of a cigarette inserted into the lighter. Means are provided for preventing the beam of energy from escaping through the opening in which the cigarette is inserted.

15 Claims, 1 Drawing Sheet

LASER CIGARETTE LIGHTER

FIELD OF THE INVENTION

This invention relates to electrically powered cigarette lighters and, more particularly, to such a lighter utilizing a laser to generate the heat to ignite a cigarette.

BACKGROUND OF THE INVENTION

Cigarette lighters, especially those which are portable and intended to be carried in a pocket or purse, generally comprise a container or reservoir for fuel, and a nozzle or wick in communication with the reservoir and adjacent an igniter for producing a flame. Such lighters must be filled periodically, or, as is more common at present, discarded, when the fuel supply is exhausted. Inasmuch as a supply of replenishing fuel is usually not available, the lighter becomes useless upon exhaustion of the fuel. The fuel itself is usually a liquified gas or a flammable liquid which often has an unpleasant odor, and it is not uncommon that the fuel will leak out of the reservoir over a period of time, which, especially in the case of flammable liquid fuel, can present a safety hazard, as does the use of an open flame. Lighters relying upon a flame are difficult to use in windy conditions, and the art is replete with devices for rendering the lighter at least partially windproof.

Lighters designed to overcome the disadvantages of fueled lighters relying upon open flame have been directed primarily to electrically activated devices which generate heat by passing current through a heating coil. In U.S. Pat. No. 3,007,027 of Hall there is shown one such lighter in which a receptacle having a heating coil therein is adapted to receive the end of a cigarette. When the body of the lighter is squeezed, current passes through the coil sufficient to heat it to ignition temperature. One potential hazard with such a design is the possibility of the case, when carried in a crowded purse, for example, being compressed enough to activate the heating coil. Inasmuch as there is no shielding mechanism, this could cause ignition of articles within the purse adjacent to the lighter.

U.S. Pat. No. 3,392,265 of King et al shows an electrical lighter utilizing a heating coil, which has a protective arrangement for pivoting the heating coil into the interior of the lighter away from the cigarette receptacle when the lighter is not in use, and which prevents activation of the coil in that position, thus materially reducing the fire hazard.

Lighters which use batteries to activate heating coils suffer primarily from a short battery life because of heavy current demands, hence relatively frequent battery recharging or replacement is required. In addition, the heating coil tends to collect ashes and unburned tobacco thereon which may get into the lighter interior, thereby necessitating frequent cleaning.

In U.S. Pat. No. 2,849,585 of Evans is shown an electrically operated optical arrangement for igniting the end of a cigarette in which a high intensity light bulb is used. Insertion of a cigarette end into the lighter activates an aperture switch arm and a switch to turn the light bulb on, and a condenser lens and mirror arrangement focuses the image of the bulb filament through the aperture on to the cigarette end, thereby igniting it. The electrical power to light the bulb is supplied by household current. Because the bulb generates a great deal of heat, it is necessary that there be a cooling air circulation within the lighter. Such a lighter arrangement eliminates the problems inherent in heating coil type lighters, but it is bulky, non-portable, and generates a great deal of heat.

SUMMARY OF THE INVENTION

The present invention is a portable cigarette lighter which is battery powered and which utilizes a unique optical system for generating heat sufficient to ignite a cigarette. In a preferred embodiment of the invention the lighter comprises a case within which is mounted a battery power supply and a small semiconductor laser such as a gallium-aluminum-arsenide laser for producing a coherent beam. An integrated electronic circuit module is also contained within the case for receiving electrical power from the batteries and converting it to the required current and voltage for activating the laser.

An optical fiber is adapted to receive the light output of the laser and transmit it to an optical system within the case. The optical system comprises in sequence a light collimating sphere, a plano-concave conic lens, a convex-plano conic lens, a focusing lens and an apertured beam blocking plate. Such an optical arrangement is designed to produce a hollow laser beam having a doughnut shaped cross-section which is focused to a point located between the focusing lens and the apertured blocking plate. Beyond the focal point the beam, which retains its doughnut shaped cross-section, expands and is blocked by the solid portion of the blocking plate surrounding the aperture, with no part of the beam escaping through the aperture.

The case has an aperture therein containing a receptacle in the form of a transparent cup with is coaxial with the optical system and has a transparent bottom wall located approximately in the plane of the focal point of the beam. The aperture and cup are adapted to receive the end of a cigarette, which rests against the bottom wall, i.e., at the focal point of the beam. An activating switch, preferably of the push button type, is adapted to activate the electronic circuitry and hence the laser so that there is a high heat concentration at the focal point sufficient to ignite the end of a cigarette within the cup.

Indicator lights, such as light emitting diodes, are mounted on the case to indicate the state of the batteries, and to indicate when the laser is operating.

The lighter of the invention is light in weight and readily portable. Any heat that is generated is concentrated at a point so that the body of the lighter remains cool. There is no danger that the laser beam might exit the lighter with a consequent potential for damage, especially to the users eyes, and any ash or unburned tobacco particles are blocked from the interior of the lighter.

The numerous features and advantages of the present invention will be more readily apparent from the following detailed description, read in conjunction with the accompanying drawings.

DETAILED DESCRIPTION

Figure 1:
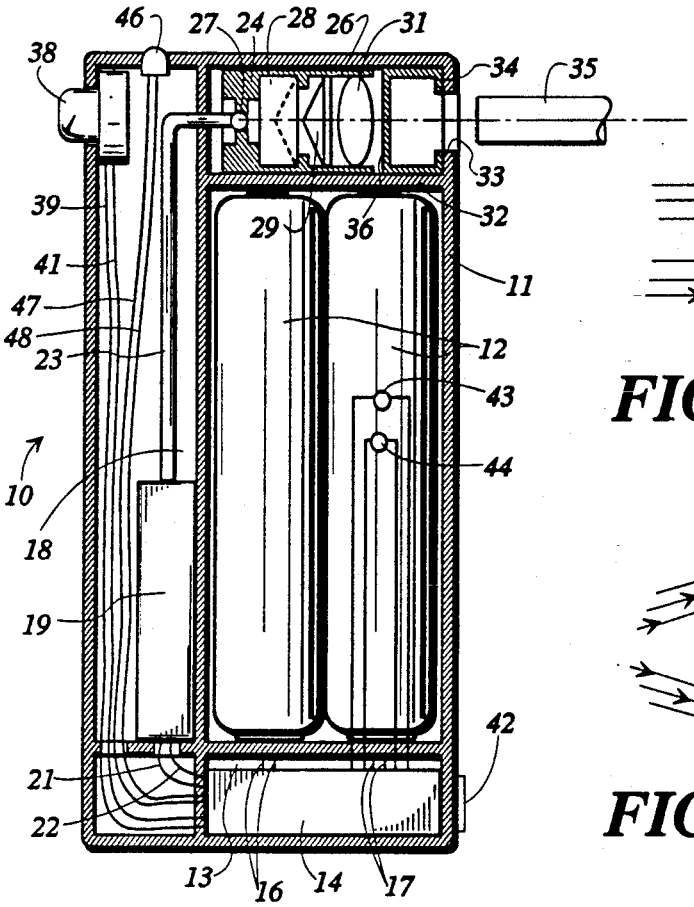
FIG. 1 is a side elevational view, in cross-section, of the lighter of the present invention.

FIG. 1 depicts the lighter 10 of the present invention, which comprises a hollow case 11 of metal, high impact plastic, or other suitable material, having mounted and supported therein a suitable power supply 12 which may comprises replaceable AA batteries or a suitable rechargeable battery. Mounted in a compartment 13 beneath the power supply 12 is an integrated circuit module 14 which receives power from supply 12 via leads 16 and 17. Also mounted within case 11 in a compartment 18 is a laser device 19. Laser 19 may be any of a number of suitable devices, such as a gallium-aluminum-arsenide (Ga Al As) laser which generates a substantially spatially and temporally coherent beam of energy. Laser 19 is adapted to be actuated by module 14 via leads 21 and 22. While the power supply, the electronic module, and the laser have been shown as separate entities within the case 11, in practice they may be packaged as a single unit, with the batteries 12 being easily replaceable.

Figure 2A:
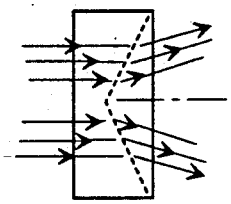
FIG. 2A is a side elevational view of the plano-concave conical lens of the present invention.
Figure 2B:
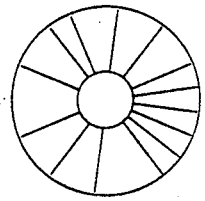
FIG. 2B is a front elevational view of the lens of FIG. 2A.
Figure 3A:
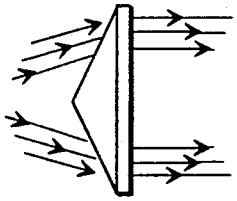
FIG. 3A is a side elevational view of the convex-plano conical lens of the present invention.
Figure 3B:
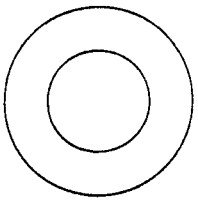
FIG. 3B is a front elevational view of the lens of FIG. 3A.
Figure 4A:
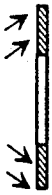
FIG. 4A is a side view, in cross-section, of the beam blocking plate of the present invention.
Figure 4B:
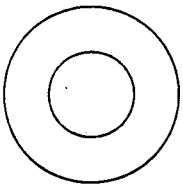
FIG. 4B is a front view of the beams blocking plate of FIG. 4A.
Figure 5:
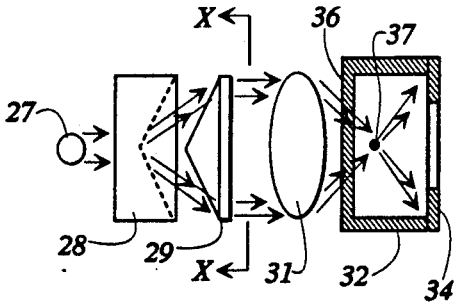
FIG. 5 is a diagram of the path of laser light incident upon the optical system of the invention.
Figure 6:
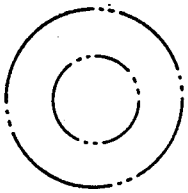
FIG. 6 is a cross-section of the light beam along the line X—X in FIG. 5.

An optical fiber 23 is connected at one end to the output of laser 19, and at the other end to an optical system 24 which is contained within case 11 at the top thereof. Optical system 24 comprises a support sleeve 26, preferably of a clear plastic material, within which are mounted in axial alignment and in sequence a collimator 27, a plano-concave conical lens 28, a convex-plano conical lens 29, and a focusing lens 31. Collimator 27, which may be, for example, a Melles-Griot collimating sphere, is adapted to receive the laser output from the end of fiber 23 and collimate it. Lens 28 which may be of optical glass or optical grade plastic having, for example, an index of refraction of approximately 1.57, and a conical pitch of approximately sixty degrees (60), is adapted to receive the laser light from the collimator 27 and to create, as best seen in FIG. 2A and FIG. 5, a spreading beam having a doughnut shaped cross-section. Lens 29, which, like lens 28, has a conical surface of approximately sixty degrees pitch and may be of glass or plastic and has an index of refraction of approximately 1.57, is adapted to receive the spreading doughnut shaped beam from lens 28 and focus it as a substantially parallel linear, hollow beam having a doughnut shaped cross-section onto focusing lens 31, as best seen in FIG. 3A and FIG. 5.

A transparent cup 32 of clear plastic or glass is mounted within case 11 in axial alignment with the optical system 24, and has an open end adjacent an aperture 33 in case 11. Between the open end of cup 32 and aperture 33 is an apertured beam blocking plate 34 which may be made, for example, of anodized aluminum. Cup 32 is adapted to receive a cigarette 35 which is inserted through aperture 33, the aperture in plate 34, and the open end of the cup, and which butts against the bottom 36 of the cup 32. As best seen in FIG. 5, focusing lens 31 is adapted to receive the doughnut cross-sectioned beam from conical lens 29 and focus it to a focal point 37, the plane of which substantially coincides with the plane of cup bottom 36. Thus, the cigarette end bearing against bottom 36 will be at the point of maximum light intensity, which raises a temperature sufficient to ignite the cigarette.

The lighter 10 of the present invention is activated by, for example, a push button switch 38 which communicates with the module 14 via lens 39 and 41, as seen in FIG. 1. It is to be understood that other arrangements for activating the lighter might be used, that shown here being by way of example only. When an externally protruding push button type switch is used, there exists the possibility that the lighter might be inadvertently activated. While little or no damage would result from such activation, it could result in an unnecessary and unwanted drain on the batteries. In order to decrease the possibilities of inadvertent activation, a rotatable key 42 is provided. Key 42 preferably has an "ON" position and an "OFF" position, and is connected to module 14 to prevent it from operating when key 42 is in the "OFF" position.

Module 14 may be designed to monitor the condition of power supply 12, and to indicate its condition by means of light emitting diodes 43 and 44. Diode 44 may emit green light, and is activated when power supply 12 has sufficient energy to activate laser 19. On the other hand, diode 43 may emit red light and is activated when the energy of power supply 12 is insufficient. Despite a green indication by diode 44, it is desirable that the operator know when laser 19 is operating, and to this end a light emitting diode 46, which is connected to laser 19 via leads 47 and 48 is adapted to emit light when the laser 19 is operating. It is to be understood that other indicating arrangements might be used, those shown here being by way of example only.

It can be appreciated from the foregoing that the lighter of the present invention is small and portable; is safe to use; does not represent a safety hazard if inadvertently actuated; and is protected from ash and tobacco particle intrusion into the interior thereof. While the invention has been described as a cigarette lighter, conversion to a cigar lighter would only require an opening and a cup of sufficient size to accommodate the end of a cigar.

The foregoing description has been directed to a preferred illustrative embodiment of the invention. Numerous other embodiments, changes and alterations may occur too workers in the art without departure from the spirit and scope of the invention.

I claim:

1. An electrically powered lighter for igniting cigarettes and the like comprising a substantially hollow case having an opening therein a power supply mounted within said case, generator means mounted within said case for receiving power from said power supply and generating a substantially coherent beam of energy, focusing means mounted within said case having an input end and an output end, means for directing the beam of energy from said generator means to the input end of said focusing means said focusing means comprising means for creating a substantially hollow beam of energy from the beam of energy incident on the input end of said focusing means, said focusing means including means for causing the hollow beam of energy to converge to an axially aligned point and to expand beyond said point, and means for blocking the expanded beam to prevent it from exiting said case through said opening.

2. An electrically powered lighter as claimed in claim 1 and further comprising a receptacle having a transparent substantially planar bottom mounted in said opening, said receptacle being axially aligned with said focusing means.

3. An electrically powered lighter as claimed in claim 2 wherein the plane of said bottom of said receptacle substantially coincides with the plane in which said axially aligned point lies.

4. An electrically powered lighter as claimed in claim 1 and further comprising control means for actuating said generator means.

5. An electrically powered lighter as claimed in claim 1 and further comprising means for indicating when said generator means has been actuated.

6. For use in a lighter having means for generating a substantially spatially and temporally coherent beam of energy, and wherein the lighter includes an opening and a receptacle mounted in the opening, a focusing system having an input end and an output end for focusing the beam of energy comprising first means for forming the beam of energy into a substantially hollow diverging beam, second means for receiving the diverging beam and forming it into a parallel beam having a doughnut shaped cross-section, and third means for causing said parallel beam to converge to a point and diverge beyond the point.

7. A focusing system as claimed in claim 6 and further comprising means for preventing the beam that diverges beyond the point from exiting the lighter.

8. A focusing system as claimed in claim 6 wherein said first, second, and third means are in axial alignment with opening in the lighter.

9. A focusing system as claimed in claim 6 and further comprising means at said input end for collimating the beam of energy.

10. A focusing system as claimed in claim 6 wherein said first means comprises a plano-concave lens wherein the concave portion thereof is conical.

11. A focusing system as claimed in claim 6 wherein said second means comprises a convex-plano lens wherein the convex portion thereof is conical.

12. An electrically powered lighter for igniting cigarettes and the like comprising a substantially hollow case having an opening therein, a receptacle mounted in said opening, said receptacle having an open end adjacent said opening and a transparent substantially planar bottom within said case, a power supply mounted within said case, first means for generating a substantially coherent beam of energy when actuated, second means for receiving energy from said power supply and actuating said first means, focusing means mounted within said case having an input end and an output end and axially aligned with said receptacle and said opening, transmission means for transmitting the beam of energy from said first means to the input end of said focusing means, said focusing means comprising a plano-concave lens for forming the beam of energy into a substantially hollow diverging beam, a convex-plano lens for forming the diverging beam into a parallel beam having a doughnut shaped cross-section and focusing means for causing the beam to converge to a point and expand beyond the point, the point lying in a plane substantially coincident with the plane of said bottom, and means adjacent said opening for blocking the diverging beam.

13. An electrically powered lighter as claimed in claim 12 wherein said first means is a laser.

14. An electrically powered lighter as claimed in claim 13 wherein said laser is a gallium-aluminum-arsenide laser.

15. An electrically powered lighter as claimed in claim 13 and further comprising means for indicating when said laser is operating.

* * * * *